US009397377B2

(12) United States Patent
Seo et al.

(10) Patent No.: US 9,397,377 B2
(45) Date of Patent: Jul. 19, 2016

(54) CAVITY FILTER

(71) Applicant: ACE TECHNOLOGIES CORPORATION, Incheon (KR)

(72) Inventors: Jae-Ok Seo, Incheon (KR); Sung-Soo Chung, Incheon (KR); Jung-Hak Ahn, Incheon (KR); Dong-Wan Chun, Incheon (KR); Kwang-Sun Park, Incheon (KR)

(73) Assignee: ACE TECHNOLOGIES CORPORATION, Incheon (KR)

( * ) Notice: Subject to any disclaimer, the term of this patent is extended or adjusted under 35 U.S.C. 154(b) by 0 days.

(21) Appl. No.: 14/671,967

(22) Filed: Mar. 27, 2015

(65) Prior Publication Data

US 2015/0280302 A1 Oct. 1, 2015

(30) Foreign Application Priority Data

Apr. 1, 2014 (KR) ..... 10-2014-0038791
Jul. 14, 2014 (KR) ..... 10-2014-0088531

(51) Int. Cl.

| | |
|---|---|
| ***H01P 1/202*** | (2006.01) |
| ***H01P 1/208*** | (2006.01) |
| ***H01P 11/00*** | (2006.01) |
| *H01P 1/205* | (2006.01) |

(52) U.S. Cl.
CPC ..... *H01P 1/2084* (2013.01); *H01P 11/007* (2013.01); *H01P 1/2053* (2013.01)

(58) Field of Classification Search
CPC ..... H01P 1/202; H01P 1/205
USPC ..... 333/205, 207, 223, 231, 235
See application file for complete search history.

(56) References Cited

U.S. PATENT DOCUMENTS

| | | | | |
|---|---|---|---|---|
| 6,362,708 | B1 * | 3/2002 | Woods | H01P 1/20309 333/219.1 |
| 6,600,394 | B1 * | 7/2003 | Wang | H01P 7/10 333/231 |
| 8,362,855 | B2 * | 1/2013 | Lee | H01P 1/2084 333/203 |
| 8,633,789 | B2 * | 1/2014 | Schon | H01P 1/2084 333/229 |
| 8,686,810 | B2 * | 4/2014 | Park | H01P 1/2053 333/203 |
| 8,981,878 | B2 * | 3/2015 | Wong | H01P 1/207 333/203 |

* cited by examiner

*Primary Examiner* — Dean Takaoka

(57) ABSTRACT

A cavity filter is disclosed. The cavity filter includes: a housing in which at least one cavity is formed where the housing has a resonator held in the cavity; a cover joined to an upper portion of the housing; and a pressing member joined to the cover. An insertion area is formed in the cover for receiving the pressing member, where the insertion area includes a thin part that has a smaller thickness than the main body of the cover. The pressing member may be inserted in the insertion area to press the thin part. The pressing member includes an insert part that is inserted in the insertion area, and an elastic member that is joined to a lower portion of the insert part to press the thin part. The cavity filter can provide stable properties as the resonators are joined to the ground in a stable manner.

19 Claims, 7 Drawing Sheets

CAVITY FILTER

CROSS-REFERENCE TO RELATED APPLICATIONS

This application claims the benefit of Korean Patent Application No. 10-2014-0038791, filed with the Korean Intellectual Property Office on Apr. 1, 2014, and Korean Patent Application No. 10-2014-0088531, filed with the Korean Intellectual Property Office on Jul. 14, 2014, the disclosures of which are incorporated herein by reference in their entirety.

BACKGROUND

1. Technical Field

The present invention relates to a filter, more particularly to a cavity filter that includes resonators.

2. Description of the Related Art

With advances in mobile communication, there have been rapid increases in demand for RF equipment such as filters, duplexers, multiplexers, and the like. RF equipment may be used in the filtering, separation, and transfer of signals in places such as base stations, etc., in a mobile communication system.

An RF filter is a device for passing the signals of a particular frequency band. In devices that require high power, such as in the base station of a mobile communication system, a cavity filter having a cavity-based structure is mainly used.

A cavity filter, the structure of which may include multiple cavities formed within the filter with resonators installed inside the cavities, is a filter that performs the filtering by way of resonance in each of the cavities.

One of the most frequently used resonators in a cavity filter is the coaxial resonator, which is structured to have a cylindrical form with a hole or recess formed therein.

As mobile communication systems require transmission and reception performance of higher and higher sensitivity, there is a critical demand for good voice call quality and data transmission. Thus, the filter installed in a mobile communication system such as a base station is required to provide steep attenuation properties for reliably eliminating spurious emissions while providing a low loss.

A filter having a high Q value to satisfy the above requirements is the TM mode dielectric resonator filter. The TM mode dielectric resonator filter may be electrically connected with the cover or housing of the filter that is in an electrically grounded state to optimize temperature properties.

Recent times have seen active research on cavity filters that are made to have a stable grounding structure between the dielectric resonators and the filter cover or housing. In order for such a cavity filter to provide stable properties that adapt to changes in temperature, etc., a stable joining may be needed between a dielectric resonator and the ground.

The mobile communication system is also required to have smaller equipment. In particular, there has been an increase in the number of low-output compact base stations that control communication for compact cells, and accordingly, there is an increase in demand for smaller sizes in the equipment included in base stations. Thus, there is a continuing demand for smaller size also in the cavity filter using resonators.

In the past, resonators having a step-impedance structure were used, in which the shape of the coaxial resonator was altered to provide a smaller size for the cavity filter. However, it may be difficult to achieve the amount of size reduction as required in a current base station by changing only the shape of the coaxial resonator.

SUMMARY

An aspect of the invention is to provide a cavity filter in which a dielectric resonator can be joined with the ground in a stable manner.

Another aspect of the invention is to provide a cavity filter that can be fabricated with a smaller structure.

One aspect of the invention provides a cavity filter that includes: a housing in which at least one cavity is formed where the housing has a resonator held in the cavity; a cover joined to an upper portion of the housing; and a pressing member joined to the cover. The cover may have an insertion area formed therein for receiving the pressing member, where the insertion area may include a thin part that has a smaller thickness than that of the main body of the cover. The pressing member may be inserted in the insertion area to press the thin part. The pressing member may include an insert part, which may be inserted in the insertion area, and an elastic member, which may be joined to a lower portion of the insert part to press the thin part.

The thin part can be formed to be in contact with the resonator.

An insertion hole can be formed in the insert part of the pressing member to receive a tuning bolt that is inserted therein, and the tuning bolt can be inserted into the housing through the insertion hole.

Threads can be formed on the inner perimeter of the insertion area and on the outer perimeter of the insert part, and the insert part can be inserted into the insertion area by rotation.

The elastic member can include a rubber of a silicone material.

A hole can be formed in the center of the thin part, and the tuning bolt can be inserted into the housing through the hole.

The cavity filter can further include a securing member that is joined to an upper portion of the pressing member and is configured to secure the pressing member.

The resonator can include a dielectric. According to an embodiment of the invention, the resonator can include a coaxial resonator and a ceramic dielectric joined to an upper portion of the coaxial resonator.

The ceramic dielectric can be implemented in an annular shape with a hole formed in its center.

Metalizing can be performed at the junction between the ceramic dielectric and the thin part.

Metalizing can be performed at the junction between the ceramic dielectric and the coaxial resonator.

Another aspect of the invention provides a cavity filter that includes: a housing having in which at least one cavity is formed, where the housing has a resonator held in the cavity; a cover that is joined to an upper portion of the housing and includes a main body and a thin part, where the thin part has a smaller thickness than the main body and has a hole formed in its center; and a pressing member configured to press the thin part. Here, the pressing member may include an elastic member configured to press the thin part.

An insertion area cab be formed in the cover, defined by the difference in thickness between the main body and the thin part, and the pressing member can be inserted in the insertion area to press the thin part.

The pressing member can include an insert part that is configured to be inserted in the insertion area, and threads can be formed on the inner perimeter of the insertion area and on the outer perimeter of the insert part.

The thin part can be formed in correspondence to the position of the resonator, and the thin part can be in contact with the resonator.

An insertion hole can be formed in the insert part to receive a tuning bolt that is inserted therein, and the tuning bolt can be inserted into the housing through the insertion hole and through a hole formed in the center of the thin part.

The elastic member can include a rubber of a silicone material.

The cavity filter can further include a securing member that is joined to an upper portion of the pressing member and is configured to secure the pressing member.

A cavity filter according to an embodiment of the invention can provide stable properties as the resonators are joined to the ground in a stable manner.

Also, a cavity filter according to an embodiment of the invention can be fabricated in a small structure, so as to be applicable to a low-output compact base station.

Additional aspects and advantages of the present invention will be set forth in part in the description which follows, and in part will be obvious from the description, or may be learned by practice of the invention.

DETAILED DESCRIPTION

Figure 1:
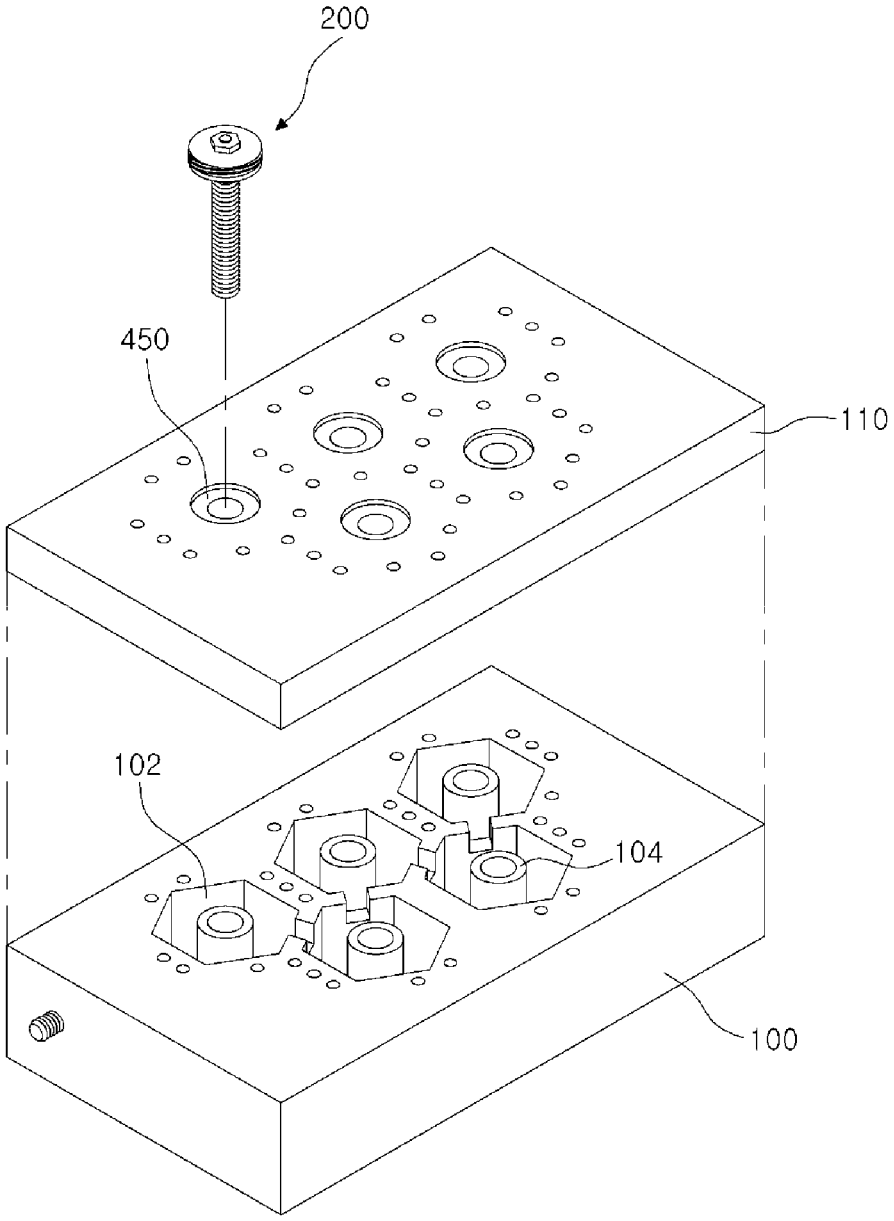
FIG. 1 is an exploded perspective view of a cavity filter according to an embodiment of the invention.

As the present invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In describing the drawings, like reference numerals are used for like elements.

Certain embodiments of the invention are described below in detail with reference to the accompanying drawings.

FIG. 1 is an exploded perspective view of a cavity filter according to an embodiment of the invention.

Referring to FIG. 1, a cavity filter according to an embodiment of the invention can include a housing 100, a cover 110, and a multiple number of pressing members 200.

The housing 100 may serve as the body of the filter, and multiple cavities 102 may be formed inside the housing. While the example illustrated in FIG. 1 includes five cavities 102, the number of cavities 102 can be changed as needed. A resonator 104 may be installed in each of the cavities 102.

According to an embodiment of the invention, the resonator 104 can be made of a dielectric material, for example a ceramic material. When a resonator 104 made of a dielectric is held inside the cavity, the resonance in each cavity 102 can be achieved in a TM mode.

A resonator 104 formed as a dielectric can have a cylindrical shape, and a recess or hole can be formed in at least a portion of the cylinder. Of course, a resonator shaped as a disc can also be used as needed, and a resonator having any of a variety of known shapes can be applied to an embodiment of the invention. The resonator 104 can be joined to a bottom portion of the cavity by using a bolt, etc.

According to another embodiment of the invention, the resonator 104 can be implemented in the form of a coaxial resonator and a ceramic dielectric 300 joined to an upper portion of the coaxial resonator. In this case, the coaxial resonator part of the resonator 104 can be made of a metallic material, while the overall structure of the resonator 104 can have a cylindrical shape with a recess or hole formed inside.

The ceramic dielectric 300 may be used to increase the capacitance formed between the coaxial resonator and the cover 110 of the cavity filter. By increasing the capacitance with the ceramic dielectric 300, it is possible to fabricate the coaxial resonator in a smaller size. The ceramic dielectric 300 may contact the cover 110 of the filter, and a structure for implementing a stable contact between the ceramic dielectric 300 and the cover 110 is described herein.

The housing 100 can be made using an aluminum material as a base and applying a silver plating treatment on the base. The silver plating may be performed to provide high electrical conductivity. Of course, the housing 100 can be used with a treatment other than silver plating, such as copper plating for example.

A multiple number of cavities 102 may be defined by the housing 100 and a multiple number of walls installed inside the housing 100. The number of cavities 102 and resonators 104 formed in the housing 100 may be associated with the insertion loss and attenuation properties of the filter. A greater number of cavities 102 and resonators 104 can provide higher attenuation properties but may also increase insertion loss. That is, increasing the number of cavities and resonators may provide better attenuation properties but increase insertion loss, posing a trade-off between the attenuation properties and the insertion loss.

The cover 110 may be joined to the upper portion of the housing 100, which may be the open side of the housing 100. The cover 110 may be joined to the upper portion of the housing 100 to form the closed structure of the housing 100. Due to the joining of the cover 110, the inside of the filter can be shielded from electromagnetic waves. The cover 110 can also be formed by preparing a base structure of aluminum and applying a silver plating treatment on the base structure.

The cover 110 and the housing 100 can be joined by using any of a variety of joining methods. For instance, the cover 110 can be joined to the housing 100 by using bolts or by soldering, etc.

A multiple number of insertion areas may be formed in the cover 110, and into each of the multiple insertion areas 450, a pressing member 200 may be inserted.

The housing 100 and cover 110 of the filter may have a ground potential, and in order to obtain the desired electrical properties and provide a strong fastening of the ceramic dielectric 300, it is necessary to tightly press the ceramic dielectric 300 onto the cover 110. The pressing member 200 may serve to provide the pressure needed for the tight pressing.

The positions of the insertion areas 450 formed in the cover 110 may correspond to the positions of the resonators 104. The insertion areas 450 may be formed over the resonators 104, and in cases where there are five resonators installed, there may be five insertion areas 450 formed in the cover.

The pressing members 200 may each be inserted into an insertion area 450, with the number of pressing members 200 corresponding to the number of insertion areas 450. The pressing member 200 may be inserted into the insertion area 450 such that it can press the cover 110 and thus provide a stable contact between the cover 110 and the resonator 104.

Figure 2:
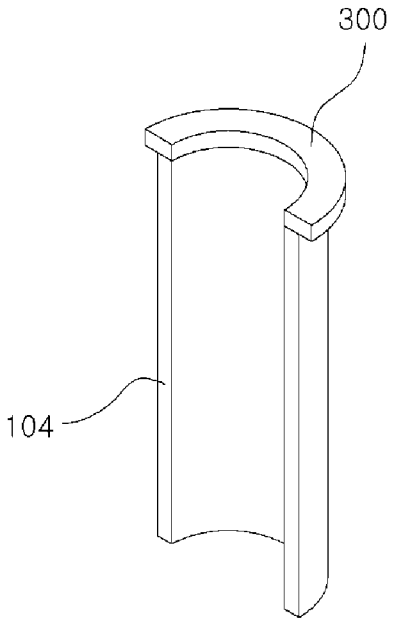
FIG. 2 illustrates the structure of a resonator in a cavity filter according to an embodiment of the invention.

FIG. 2 illustrates the structure of a resonator in a cavity filter according to an embodiment of the invention.

Referring to FIG. 2, a resonator 104 in a cavity filter according to an embodiment of the invention can be implemented as a ceramic dielectric 300 joined to the upper portion of a coaxial resonator. The ceramic dielectric 300 can be joined to the upper portion of the coaxial resonator by any of a variety of joining methods such as bonding, soldering, etc.

At the junction where the ceramic dielectric 300 and the coaxial resonator are joined, a metalizing procedure can be applied. The metalizing performed at the junction of the ceramic dielectric 300 and the coaxial resonator can prevent the occurrence of minute gaps in the junction between the ceramic dielectric 300 and coaxial resonator and can thus prevent degradations in performance. The metalizing can be performed by any of a variety of methods such as dry plating, wet plating, applying Ag paste, etc.

The height at which the coaxial resonator and the ceramic dielectric 300 are joined may correspond to the height of the inside of the housing such that the ceramic dielectric 300 may be in contact with the cover 110 of the filter.

The ceramic dielectric 300 may have an annular shape and have a hole formed therein. The hole inside the ceramic dielectric and the hole or recess formed in the coaxial resonator may be the area for inserting a tuning bolt, as described later on.

The ceramic dielectric 300 may be a dielectric having a high dielectric constant, and because of the high dielectric constant of the ceramic dielectric, the capacitance formed between the coaxial resonator and the cover 110 may be increased. The sizes of the coaxial resonators and the cavities 102 may be determined by the operating frequency of the filter. The lower the operating frequency, the larger the sizes needed for the coaxial resonators and cavities 102.

The ceramic dielectric 300 may increase the capacitance between the cover 110 and the coaxial resonator, so that the sizes of the coaxial resonators and cavities 102 can be reduced compared to the case in which there are no ceramic dielectrics 300.

Figure 3:
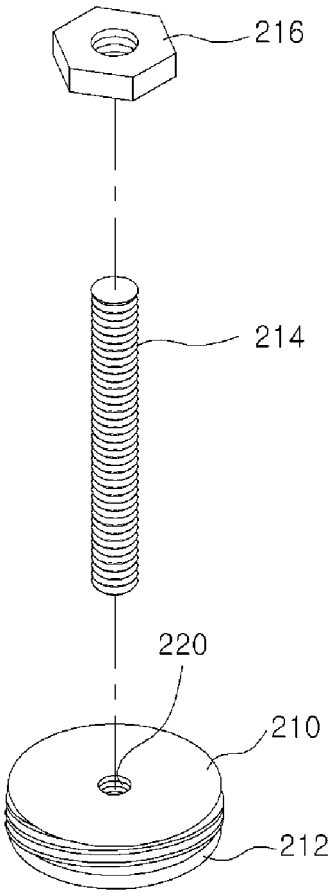
FIG. 3 is an exploded perspective view of a pressing member that may be applied to a cavity filter according to an embodiment of the invention.
Figure 4:
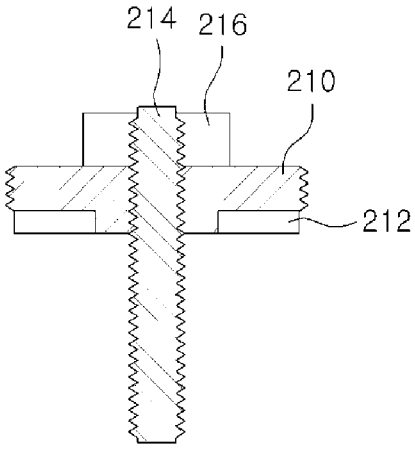
FIG. 4 is a cross-sectional view of a pressing member that may be applied to a cavity filter according to an embodiment of the invention.

FIG. 3 is an exploded perspective view of a pressing member that may be applied to a cavity filter according to an embodiment of the invention, and FIG. 4 is a cross-sectional view of a pressing member that may be applied to a cavity filter according to an embodiment of the invention.

Referring to FIG. 3, a pressing member 200 according to an embodiment of the invention can include a insert part 210, an elastic member 212, and a tuning bolt 214.

The insert part 210 may be the portion that is inserted in the insertion area of the cover 110 as described later on. The insert part 210 can have a cylindrical structure, and a thread can be formed on its outer perimeter to be inserted into the insertion area of the cover 110. The insert part 210 can be made of a metallic material.

An insertion hole 220 may be formed in a center portion of the insert part 210, and the tuning bolt 214 may be joined at the insertion hole 220. A thread may be formed on the inner perimeter of the insertion hole 220 of the insert part 210, and a thread may also be formed on the outer perimeter of the tuning bolt 214, so that the tuning bolt may be inserted through the insertion hole 220 by way of a screw joint. The tuning bolt 214 can be inserted through the insertion hole 220 by rotation, and the depth to which it is inserted can be adjusted based on the degree of rotation.

The elastic member 212 may be joined to a lower portion of the insert part 210. For example, the elastic member 212 can be joined to the lower portion of the insert part 210 by bonding. Of course, various joining methods other than bonding can also be used.

Referring to FIG. 4, the elastic member 212 can have an annular shape with a hole formed in the center. The elastic member 212 may be the component for pressing the filter cover, and a rubber of a silicone material, for example, can be used for the elastic member 212.

Figure 5:
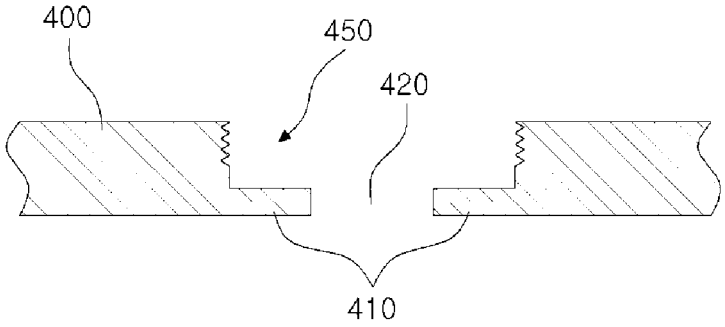
FIG. 5 is a cross-sectional view of an area where a pressing member may be applied in the cover of a cavity filter according to an embodiment of the invention.

FIG. 5 is a cross-sectional view of an area where a pressing member may be applied in the cover of a cavity filter according to an embodiment of the invention.

Referring to FIG. 5, a cover according to an embodiment of the invention can include a main body 400, a thin part 410, and a hole 420.

The main body 400 may have a rectangular shape and a particular thickness. At a certain portion of the main body 400, a thin part 410 may be formed, which has a thickness smaller than that of the main body 400. By forming such thin parts 410 having smaller thicknesses than the main body 400, insertion areas 450 may be formed in the main body 400 in which to inset the pressing members 200.

Referring to FIG. 1, a thin part 410 may have an annular shape and may have a hole 420 formed in the center portion of the thin part 410. The thickness of the thin part 410 may be set to such an extent that a deformation may occur according to the pressing by the pressing member 200. The thin part 410 may preferably take the shape of a circular ring, and the hole 420 may also preferably be of a circular shape.

The insertion area 450, formed by the difference in thickness between the main body 400 and the thin part 410, may have a thread formed on its inner perimeter.

Figure 6:
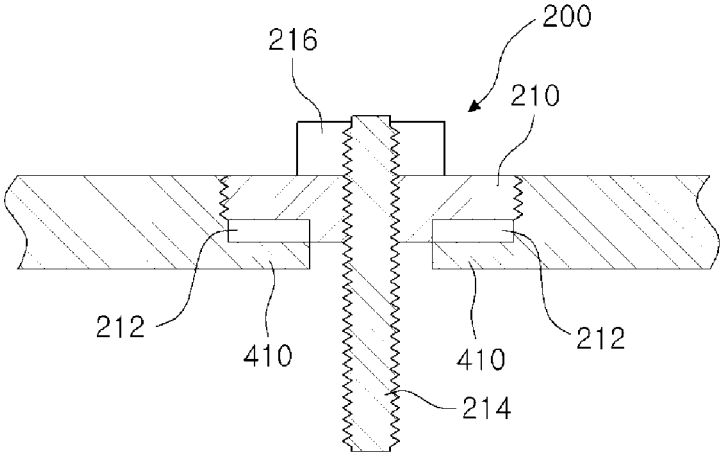
FIG. 6 cross-sectional view of a pressing member joined to the cover of a cavity filter according to an embodiment of the invention.

FIG. 6 cross-sectional view of a pressing member joined to the cover of a cavity filter according to an embodiment of the invention.

Referring to FIG. 6, the insert part 210 of the pressing member 200 may be inserted in the insertion area 450 that is formed by the thickness difference between the main body 400 and the thin part 410 of the filter cover. The pressing member 200 can be inserted into the insertion area 450 by way of a screw joining. Using the thread formed on the inner perimeter of the insertion area 450 and the thread formed on the outer perimeter of the insert part 210, the insert part 210 may be rotated and inserted into the insertion area. The rotation of the insert part 210 may be performed until the insert part 210 is completely placed in the insertion area 450.

In the hole 420 formed in the insertion area 450, a tuning bolt 214 may be inserted. The tuning bolt 214 may be inserted into the housing 100 through the hole 420, the tuning bolt 214 used for tuning the properties of the filter. The tuning bolt 214 may be used for tuning the resonance frequency or the bandwidth of the filter. Such tuning of the resonance frequency or bandwidth of the filter can be performed by adjusting the depth to which the tuning bolt 214 is inserted.

When the desired filter properties are obtained by the tuning, the position of the tuning bolt 214 may be secured by using a nut 216.

When the insert part 210 is inserted in the insertion area 450, the elastic member 212 joined to the lower portion of the insert part 210 may press the thin part 410 of the insertion area 450. Since the thin part 410 may have a thickness that allows a deformation in shape according to the pressure applied, the thin part may be directed in a downward direction according to the pressing of the elastic member 212.

The elastic member 212, such as silicone rubber for example, may provide an elastic force, making it possible to press on the thin part 410 continuously.

Figure 7:
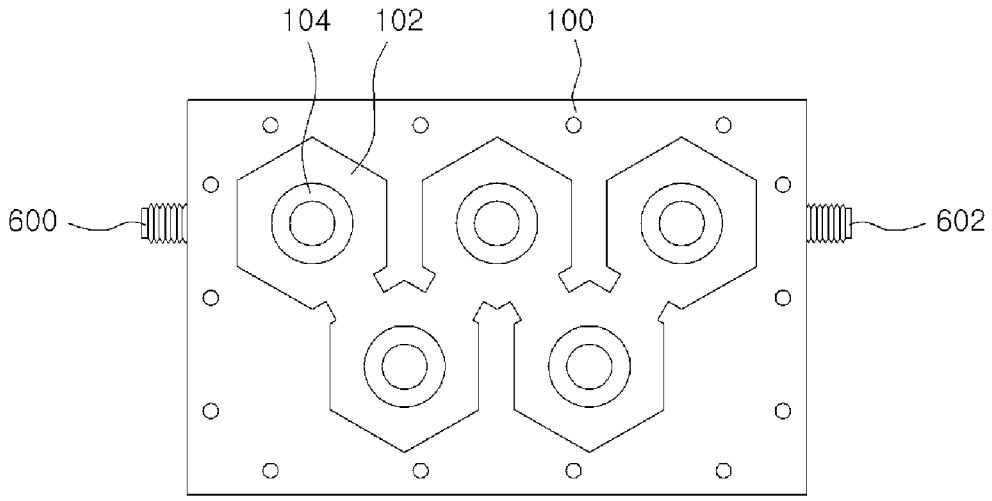
FIG. 7 is a plan view of the inside of a cavity filter according to an embodiment of the invention.

FIG. 7 is a plan view of the inside of a cavity filter according to an embodiment of the invention.

Referring to FIG. 7, the cavity filter may be equipped with an input port 600 and an output port 602, where the RF signals for filtering may be inputted through the input port 600, and the filtered output signals may be outputted through the output port 602.

FIG. 7 illustrates an example in which there are five cavities 102 and five resonators 104, and in which the filtering is performed by way of resonance in each of the cavities. A resonator 104 may be included in each cavity 102, and the resonance frequency achieved in each cavity may be determined by the size and form of the resonator 104.

Figure 8:
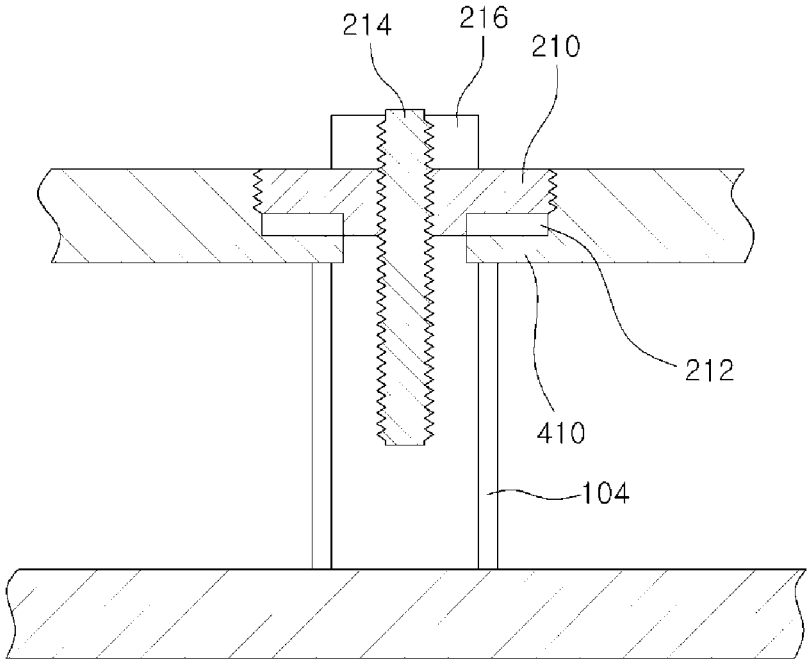
FIG. 8 is a cross-sectional view of a cavity in a cavity filter according to an embodiment of the invention.

FIG. 8 is a cross-sectional view of a cavity in a cavity filter according to an embodiment of the invention. FIG. 8 illustrates an example in which the resonator 104 is formed as a dielectric.

Referring to FIG. 8, the thin part 410 of the cover 110 may contact the resonator 104. The height of the dielectric resonator 104 may be similar to the height of the housing 100. The elastic member 212 of the pressing member 200 may be inserted in the insertion area 450 and may press on the thin part 410, and the pressing by the pressing member 200 can allow a more stable contact between the dielectric resonator 104 and the thin part 410.

As the elastic member 212 of the pressing member 200 has an elastic quality, such as a silicone rubber, it is possible to press the thin part 410 continuously due to its restorative force. Therefore, even if a vibration, etc., is applied to the filter, the dielectric resonator 104 can maintain contact with the thin part 410 in a stable manner.

Figure 9:
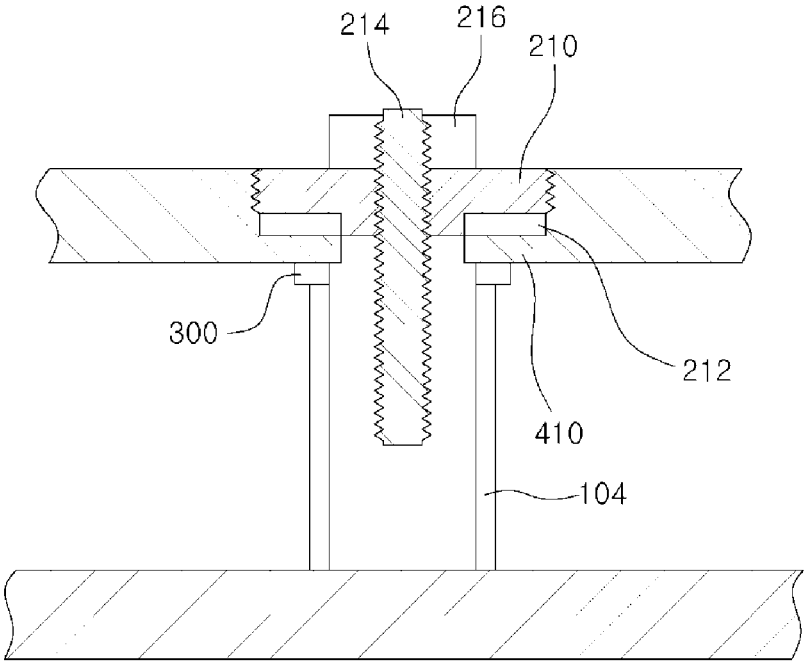
FIG. 9 is a cross-sectional view of a cavity in a cavity filter according to another embodiment of the invention.

FIG. 9 is a cross-sectional view of a cavity in a cavity filter according to another embodiment of the invention. FIG. 9 illustrates an example in which the resonator 104 is formed as a coaxial resonator and a ceramic dielectric 300 joined to the coaxial resonator.

Referring to FIG. 9, the thin part 410 of the cover 110 may contact the ceramic dielectric 300 joined to the coaxial resonator. The height of the coaxial resonator may be similar to the height inside the housing 100. The elastic member 212 of the pressing member 200 may be inserted in the insertion area 450 and may press on the thin part 410, and the pressing by the pressing member 200 can allow a more stable contact between the ceramic dielectric 300 and the thin part 410.

As the elastic member 212 of the pressing member 200 has an elastic quality, such as a silicone rubber, it is possible to press the thin part 410 continuously due to its restorative force. Therefore, even if a vibration, etc., is applied to the filter, the ceramic dielectric 300 can maintain contact with the thin part 410 in a stable manner.

A metalizing procedure can also be applied at the junction where the ceramic dielectric 300 and the thin part 410 of the cover are joined. The metalizing performed at the junction of the thin part 410 and the ceramic dielectric 300 can provide a mechanical grounding in a stable manner. The metalizing at the junction of the ceramic dielectric 300 and the thin part 410 of the cover can be performed by any of a variety of methods such as dry plating, wet plating, applying Ag paste, etc., similar to the metalizing at the junction of the ceramic dielectric 300 and the coaxial resonator.

While FIG. 8 and FIG. 9 illustrate the manner in which the resonator and cover contact each other in one cavity, the structure shown in FIG. 8 or FIG. 9 can be formed in each of the cavities.

Figure 10:
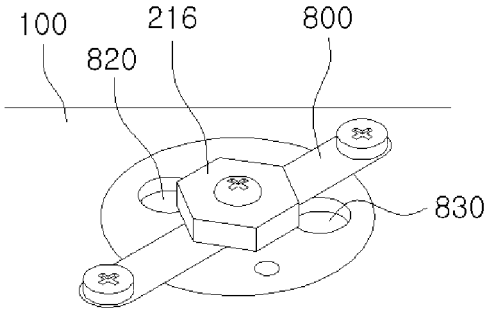
FIG. 10 illustrates an example of a securing member for securing the pressing member in a stable manner in a cavity filter according to an embodiment of the invention.

FIG. 10 illustrates an example of a securing member for securing the pressing member in a stable manner in a cavity filter according to an embodiment of the invention.

Referring to FIG. 10, a securing member 800 for securing the pressing member 200 can be formed on the cover 110 of the filter. In case the pressing member 200 is made to change position or become attached by a vibration, etc., a securing member 800 may be applied to secure the pressing member 200 in a stable manner.

The securing member 800 can be joined to an upper portion of the pressing member 200 inserted in the insertion area. As illustrated in FIG. 8, the securing member 800 can have a linear form, and can be joined to the filter's cover 110 by a bolt.

The pressing member illustrated in FIG. 10 has two recesses 820, 830 formed, into which a tool for rotating the pressing member 200 can be inserted when rotating the pressing member 200 for removal.

Figure 11:
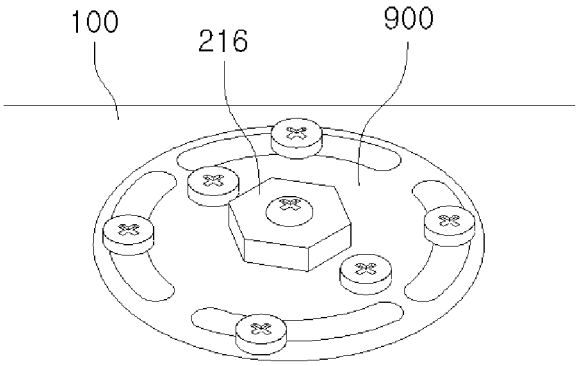
FIG. 11 illustrates another example of a securing member for securing the pressing member in a stable manner in a cavity filter according to an embodiment of the invention.

FIG. 11 illustrates another example of a securing member for securing the pressing member in a stable manner in a cavity filter according to an embodiment of the invention.

In FIG. 11, the securing member 900 may take the form of a cap that covers the entire pressing member, and may be joined to an upper portion of the pressing member 200.

While the present invention has been described above using particular examples, including specific elements, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the technical field to which the present invention pertains. Therefore, the spirit of the present invention must not be limited to the embodiments described herein, and the scope of the present invention must be regarded as encompassing not only the claims set forth below, but also their equivalents and variations.

What is claimed is:

1. A cavity filter comprising:

a housing having at least one cavity formed therein, the housing having a resonator held in the cavity;

a cover joined to an upper portion of the housing; and a pressing member joined to the cover, wherein the cover has an insertion area formed therein for receiving the pressing member, the insertion area has a thin part formed therein, the thin part having a smaller thickness than a main body of the cover, the pressing member inserted in the insertion area to press the thin part, and the pressing member comprises an insert part and an elastic member, the insert part inserted in the insertion area, the elastic member joined to a lower portion of the insert part to press the thin part.

2. The cavity filter of claim 1, wherein the thin part contacts the resonator.

3. The cavity filter of claim 2, wherein the insert part of the pressing member has an insertion hole formed therein for receiving a tuning bolt, and the tuning bolt is inserted into the housing through the insertion hole.

4. The cavity filter of claim 2, wherein threads are formed on an inner perimeter of the insertion area and on an outer perimeter of the insert part, and the insert part is inserted into the insertion area by way of rotation.

5. The cavity filter of claim 2, wherein the elastic member comprises a rubber of a silicone material.

6. The cavity filter of claim 3, wherein a hole is formed in a center of the thin part, and the tuning bolt is inserted into the housing through the hole.

7. The cavity filter of claim 1, further comprising a securing member joined to an upper portion of the pressing member, the securing member configured to secure the pressing member.

8. The cavity filter of claim 1, wherein the resonator comprises a dielectric.

9. The cavity filter of claim 8, wherein the resonator comprises a coaxial resonator and a ceramic dielectric joined to an upper portion of the coaxial resonator.

10. The cavity filter of claim 9, wherein the ceramic dielectric has an annular shape with a hole formed in a center thereof.

11. The cavity filter of claim 9, wherein metalizing is performed at a junction between the ceramic dielectric and the thin part.

12. The cavity filter of claim 9, wherein metalizing is performed at a junction between the ceramic dielectric and the coaxial resonator.

13. A cavity filter comprising:

a housing having at least one cavity formed therein, the housing having a resonator held in the cavity;

a cover joined to an upper portion of the housing, the cover comprising a main body and a thin part, the thin part having a smaller thickness than the main body and having a hole formed in a center thereof; and a pressing member configured to press the thin part, wherein the pressing member comprises an elastic member configured to press the thin part.

14. The cavity filter of claim 13, wherein the cover has an insertion area formed therein due to a difference in thickness between the main body and the thin part, and the pressing member is inserted in the insertion area to press the thin part.

15. The cavity filter of claim 14, wherein the pressing member comprises an insert part configured to be inserted in the insertion area, and threads are formed on an inner perimeter of the insertion area and on an outer perimeter of the insert part.

16. The cavity filter of claim 13, wherein the thin part is formed in correspondence to a position of the resonator, and the thin part contacts the resonator.

17. The cavity filter of claim 15, wherein the insert part has an insertion hole formed therein for receiving a tuning bolt, and the tuning bolt is inserted into the housing through the insertion hole and through a hole formed in a center of the thin part.

18. The cavity filter of claim 13, wherein the elastic member comprises a rubber of a silicone material.

19. The cavity filter of claim 13, further comprising a securing member joined to an upper portion of the pressing member, the securing member configured to secure the pressing member.

* * * * *